US008474734B2

(12) United States Patent
Kondo et al.

(10) Patent No.: US 8,474,734 B2
(45) Date of Patent: Jul. 2, 2013

(54) INJECTOR

(75) Inventors: Jun Kondo, Nagoya (JP); Tomoki Fujino, Okazaki (JP); Shu Kagami, Nagoya (JP)

(73) Assignee: Denso Corporation, Kariya (JP)

( * ) Notice: Subject to any disclaimer, the term of this patent is extended or adjusted under 35 U.S.C. 154(b) by 651 days.

(21) Appl. No.: 12/763,523

(22) Filed: Apr. 20, 2010

(65) Prior Publication Data

US 2010/0264239 A1 Oct. 21, 2010

(30) Foreign Application Priority Data

Apr. 20, 2009 (JP) ..... 2009-102281

(51) Int. Cl.
*F02M 51/00* (2006.01)

(52) U.S. Cl.
USPC ..... 239/585.1; 239/69; 239/71; 239/88; 239/96; 239/585.5; 123/446

(58) Field of Classification Search
USPC ..... 239/67, 69, 71, 74, 88–96, 585.1, 239/585.4, 585.5; 123/446, 456
See application file for complete search history.

(56) References Cited

U.S. PATENT DOCUMENTS 4,373,671 A * 2/1983 Giardini ..... 239/585.5
7,896,257 B2 * 3/2011 Yan ..... 239/71
2008/0228374 A1 9/2008 Ishizuka et al.
2009/0056676 A1 3/2009 Nakata et al.
2009/0063011 A1 3/2009 Nakata et al.

FOREIGN PATENT DOCUMENTS

JP S54-129227 10/1979
JP S56-118553 9/1981
JP H11-324870 11/1999
JP 2009-222048 10/2009

OTHER PUBLICATIONS

Japanese Office Action dated Sep. 25, 2012, issued in corresponding Japanese Application No. 2009-102281, with English Translation.
Chinese Office Action dated Oct. 20, 2011, issued in corresponding Chinese Application No. 201010164793.2 with English Translation.

* cited by examiner

*Primary Examiner* — Steven J Ganey
(74) *Attorney, Agent, or Firm* — Nixon & Vanderhye PC

(57) ABSTRACT

An injector includes a nozzle body, a main body including a supply port on the outer peripheral surface of the main body and a high pressure passage, and a fuel pressure sensor on an outer peripheral surface of the main body to detect fuel pressure. The high pressure passage has a first passage extending from the supply port in a radial direction of the main body, and a second passage extending from a fuel downstream end portion of the first passage toward an injection hole in an insertion direction of the nozzle body. The supply port and the sensor are diametrically opposed to each other. The main body includes a sensor passage, which branches from the high pressure passage to extend from the fuel downstream end portion of the first passage in an imaginary extension of the first passage so that fuel flows into the sensor through the sensor passage.

4 Claims, 5 Drawing Sheets

INJECTOR

CROSS REFERENCE TO RELATED APPLICATION

This application is based on and incorporates herein by reference Japanese Patent Application No. 2009-102281 filed on Apr. 20, 2009.

BACKGROUND OF THE INVENTION

1. Field of the Invention

The present invention relates to an injector that is disposed in an internal combustion engine to inject fuel, which serves for combustion, through a nozzle hole.

2. Description of Related Art

In order to accurately control output torque and a state of emissions of an internal combustion engine, it is important to accurately control a state of fuel injection, such as injection start time and injection quantity of fuel injected from an injector. Accordingly, a technology for detecting an actual state of injection by detecting pressure of fuel that varies with the injection is conventionally proposed. For example, actual injection start time is detected by detecting the start time of decrease of fuel pressure in accordance with the injection start, and actual injection completion time is detected by detecting time for the stop of increase of fuel pressure in accordance with completion of the injection (e.g., JP-A-2008-144749 corresponding to US2008/0228374A1; JP-A-2009-057926 corresponding to US2009/0056676A1: JP-A-2009-057927 corresponding to US2009/0063011A1).

In detecting such a fluctuation of fuel pressure, the fluctuation of fuel pressure caused due to the injection is buffered in the common rail using a fuel pressure sensor (rail pressure sensor) that is disposed directly in a common rail (pressure accumulation container). Therefore, accurate fluctuation of fuel pressure cannot be detected. For this reason, the inventions described in JP-A-2008-144749, JP-A-2009-057926, and JP-A-2009-057927 aim to detect the fuel pressure fluctuation before the fuel pressure fluctuation due to the injection is buffered in a common rail, by disposing a fuel pressure sensor in an injector.

However, although the disposition of the fuel pressure sensor in the injector is described, details of its arrangement position are not described in the above-cited publications JP-A-2008-144749, JP-A-2009-057926, or JP-A-2009-057927. Accordingly, as illustrated in FIG. 6, the present inventors have studied structure of an injector for disposing a fuel pressure sensor 80*x*.

More specifically, the injector is configured to include a main body 40*x* having a supply port 421*ax* for high pressure fuel on an outer peripheral surface of its cylinder, and the fuel pressure sensor 80*x* attached to the main body 40*x*. A high pressure passage (first passage 421*x* and second passage 422*x*) through which high pressure fuel flows from the supply port 421*ax* toward a nozzle hole (not shown), and a sensor passage 46*x* which branches from the first passage 421*x* to guide high pressure fuel to the fuel pressure sensor 80*x*, are formed by drilling inside the main body 40*x*.

The first passage 421*x* extends from the supply port 421*ax* toward a central portion of the main body 40*x*, and the second passage 422*x* extends from a downstream end of the first passage 421*x* toward the nozzle hole. The sensor passage 46*x* branches from halfway along the first passage 421*x*.

Nevertheless, by using the above-described structure in which the sensor passage 46*x* branches from a halfway portion of the first passage 421*x*, working man-hours for passages increase because of the addition of the sensor passage 46*x* to the first passage 421*x* and the second passage 422*x*. Furthermore, since the sensor passage 46*x* branches from halfway along the first passage 421*x*, a branching portion (i.e., regions indicated by numerals y1, y2 in FIG. 6), in which stress by the high pressure fuel is concentrated, increases, so that pressure resistance inside the main body 40*x* against the high pressure fuel is reduced.

In view of this problem, the present inventors have examined branching of the sensor passage 460*x* (see an alternate long and short dash line in FIG. 6) from the downstream end of the first passage 421*x* toward the opposite side from the second passage 422*x*. As a result of this examination, the sensor passage 460*x* is drilled in the main body 40*x* at one time along with the second passage 422*x*, so that increase of working man-hours is avoided. Moreover, the stress concentration region y2 is eliminated, and the pressure resistance inside the main body 40*x* is thereby improved.

However, on the other hand, when forming the second passage 422*x* and the sensor passage 460*x* at one time, the forming length (see L1 in FIG. 6) is made great. Therefore, it is made difficult to accurately couple an upper end portion of the sensor passage 460*x* to a communicating passage 461*x* that communicates between a predetermined portion of the fuel pressure sensor 80*x* and the sensor passage 460*x*. Accordingly, high precision is required to form the second passage 422*x* and the sensor passage 46*x*.

SUMMARY OF THE INVENTION

The present invention addresses at least one of the above disadvantages.

According to the present invention, there is provided an injector for an internal combustion engine, including a nozzle body, a main body, and a fuel pressure sensor. The nozzle body is adapted to be inserted and disposed in a cylinder head of the engine, and includes an injection hole through which high pressure fuel is injected. The main body has a cylindrical shape extending in a direction of insertion of the nozzle body in the cylinder head, and includes a supply port and a high pressure passage. The supply port is formed on an outer peripheral surface of the main body. High pressure fuel is supplied into the main body through the supply port. High pressure fuel flows from the supply port toward the injection hole through the high pressure passage, and the high pressure passage has a first passage and a second passage. The first passage extends from the supply port in a radial direction of the main body. The second passage extends from a fuel downstream end portion of the first passage toward the injection hole in the direction of insertion of the nozzle body. The fuel pressure sensor is attached on the outer peripheral surface of the main body and configured to detect pressure of high pressure fuel. The supply port and the sensor are diametrically opposed to each other. The main body further includes a sensor passage, which branches from the high pressure passage in such a manner as to extend from the fuel downstream end portion of the first passage in an imaginary extension of the first passage so that high pressure fuel flows into the sensor through the sensor passage.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
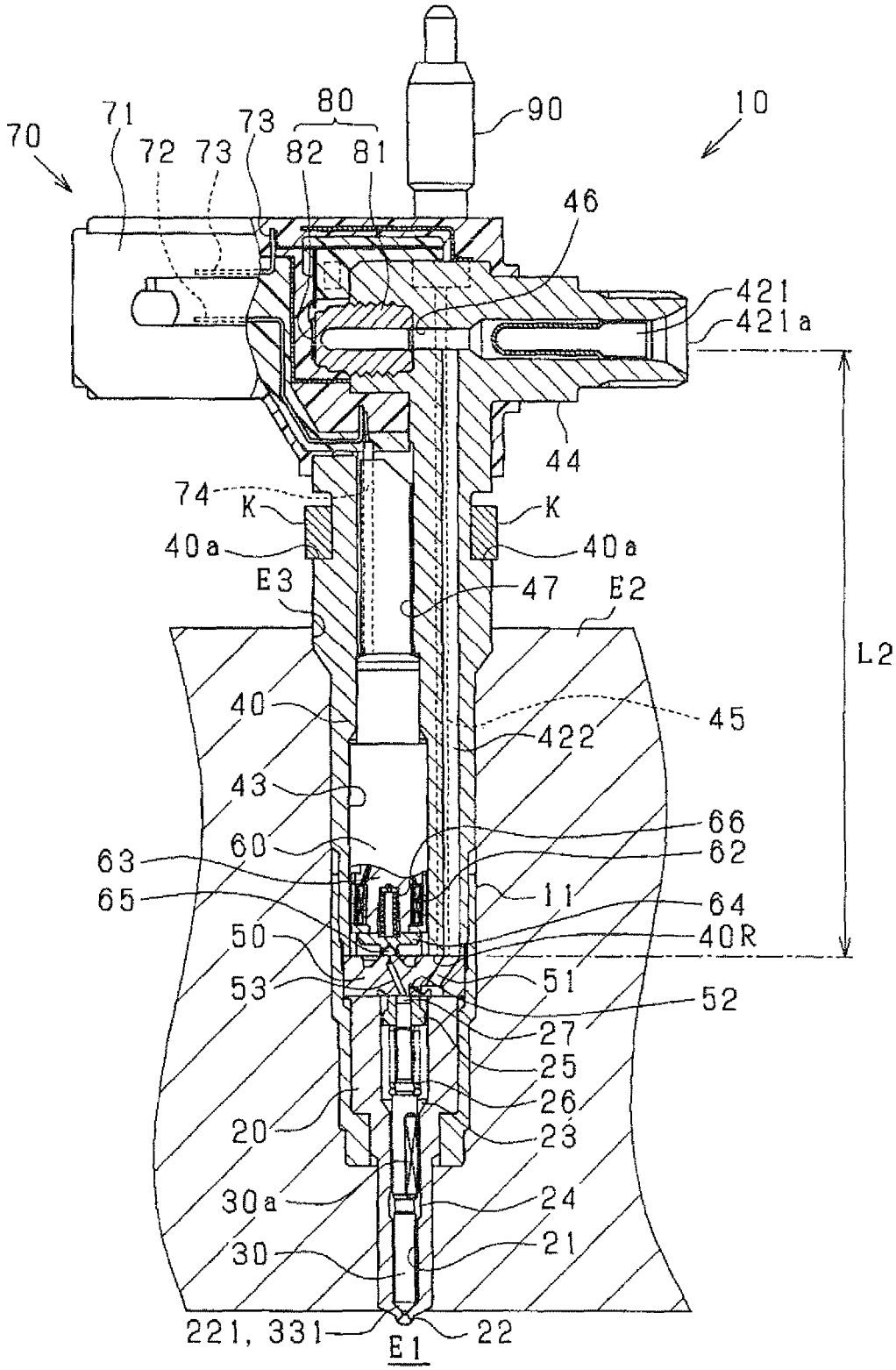
FIG. 1 is a full sectional view illustrating an injector in accordance with a first embodiment of the invention.

Embodiments, in which an injector in accordance with the invention is applied to a common-rail fuel injection system for a diesel engine (internal combustion engine) that is mounted on a vehicle, will be described below with reference to the accompanying drawings. The same numerals are used in the drawings to indicate the same or equivalent parts in the following embodiments, and the preceding description of the component having the same numeral is referred to when explaining the parts with the same numerals.

First Embodiment

An injector 10 is inserted and disposed in a cylinder head E2 of the engine to inject fuel, which is supplied from a common rail, directly into a combustion chamber E1 in each cylinder of the engine.

First, the entire structure of the injector 10 will be described with reference to FIG. 1. The injector 10 includes a nozzle body 20, a needle 30, a main body 40, an orifice plate 50, and an electromagnetic unit 60.

The nozzle body 20 and a part of the main body 40 are inserted and disposed in a body insertion hole E3 that is formed in the cylinder head E2 of the engine. An engagement part 40*a* (pressing surface), which is in engagement with one end of a clamp K, is formed on the main body 40, and by screwing the other end of the clamp K on the cylinder head E2 with a bolt, the one end of the clamp K presses the engagement part 40*a* toward the body insertion hole E3. As a result, the injector 10 is fixed to the cylinder head E2, being pressed against the inside of the body insertion hole E3.

The nozzle body 20 is fixed by a retaining nut 11 to a lower side (i.e., nozzle hole side) of the main body 40 in FIG. 1 with the orifice plate 50 therebetween. A guide hole 21 (needle accommodating chamber) that slidably accommodates the needle 30, and a nozzle hole (injection hole) 22 through which fuel is injected when the needle 30 is lifted up, for example, are formed in the nozzle body 20. A nozzle hole 22-side of the nozzle body 20 (i.e., lower side in FIG. 1) is hereinafter referred to as a 'lower side' or 'downward,' and an opposite side of the nozzle body 20 from the nozzle hole 22 (i.e., upper side in FIG. 1) is referred to as an 'upper side' or 'upward.'

The guide hole 21 is drilled in the nozzle body 20 from its upper end surface toward its front end portion, and a clearance between an inner peripheral surface of the guide hole 21 and an outer peripheral surface of the needle 30 serves as a high pressure passage 23 leading high pressure fuel into the nozzle hole 22. A fuel accumulation chamber 24, at which an inner diameter of the nozzle body 20 increases, is formed in a halfway portion of the guide hole 21. An upstream end of the high pressure passage 23 (guide hole 21) opens on the upper end surface of the nozzle body 20, and the high pressure passage 23 is thereby connected to a high pressure passage 51 which is formed in the orifice plate 50.

A seating surface 221 having a conical shape is formed on a portion of an inner peripheral surface of the nozzle body 20 at a front end of the high pressure passage 23, and a seat surface 331, which is engaged with this seating surface 221, is formed on a front end portion of the needle 30. As a result of the engagement of the seat surface 331 with the seating surface 221, the needle 30 closes and blocks the high pressure passage 23 which leads into the nozzle hole 22.

A cylinder 25 having a cylindrical shape is disposed in the guide hole 21, and a spring 26, which presses the needle 30 in a valve closing direction (i.e., downward direction in FIG. 1), is disposed between a lower end surface of the cylinder 25 and an upper end surface of the needle 30. A backpressure chamber 27, which applies pressure of high pressure fuel to the upper end surface of the needle 30 as a back pressure of the needle 30, is defined by an inner peripheral surface of the cylinder 25. By this back pressure, the needle 30 is urged in the valve closing direction. Additionally, the pressure of high pressure fuel in the fuel accumulation chamber 24 urges the needle 30 in a valve opening direction (upward in FIG. 1).

A high pressure port 44 (high pressure pipe connection), which is connected to a high pressure pipe (not shown), is formed on an outer peripheral surface of the main body 40 having a generally cylindrical shape, and a low pressure connector 90 (low pressure pipe connection), which is connected to a low pressure pipe (not shown), is attached on an upper end surface of the main body 40. Fuel, which is supplied from the common rail into the high pressure port 44 through the high pressure pipe, is fed into the main body 40 from an outer peripheral surface-side of the main body 40 having a cylindrical shape. A surplus of the supplied high pressure fuel is discharged from an upper end surface-side of the main body 40 through the low pressure connector 90.

High pressure passages 421, 422, an accommodating hole 43, a low pressure passage 45, a sensor passage 46, and a lead wire insertion hole 47, for example, are formed in the main body 40. The high pressure passages 421, 422 guide the high pressure fuel, which is introduced to the high pressure port 44, into the high pressure passage 23 in the nozzle body 20 through the high pressure passage 51 in the orifice plate 50. The electromagnetic unit 60 is inserted and disposed in the accommodating hole 43. The low pressure passage 45 leads surplus fuel from the backpressure chamber 27 to the low pressure connector 90. The sensor passage 46 and the lead wire insertion hole 47 are described in greater detail hereinafter.

The accommodating hole 43, the low pressure passage 45, the lead wire insertion hole 47, and a second passage 422 (described in greater detail hereinafter) that constitutes the high pressure passage 422 have shapes extending in an axial direction of the injector 10 (i.e., upper and lower directions in FIG. 1). The axial direction means a longitudinal direction of the injector 10, and also means an insertion direction of the injector 10, which is inserted and disposed in the cylinder head E2.

In the present embodiment, the electromagnetic unit 60 and the high pressure passage (second passage 422) are arranged to be located side by side in a direction that is perpendicular to the axial direction of the main body 40 (i.e., right and left directions in FIG. 1).

An inflow passage 52, through which high pressure fuel flows into the backpressure chamber 27 from the high pressure passage 51, and an outflow passage 53, through which fuel flows out from the backpressure chamber 27 to the low-pressure side, are formed in the orifice plate 50. An inflow-side orifice is provided for the inflow passage 52, and an outflow-side orifice is provided for the outflow passage 53.

The electromagnetic unit 60 includes a stator 63 having a magnet coil 62, an armature 64 that is movable and opposed to the stator 63, and a ball valve 65 (control valve) that is movable integrally with the armature 64 to open and close the outflow passage 53.

A connector 70 is attached to an upper part of the main body 40, and the connector 70 includes a connector housing 71 made of resin, and a driving connector terminal 72 and a sensor connector terminal 73 that are held in the connector housing 71. The magnet coil 62 of the electromagnetic unit 60 and the driving connector terminal 72 are electrically connected by a lead wire 74.

Figure 2:
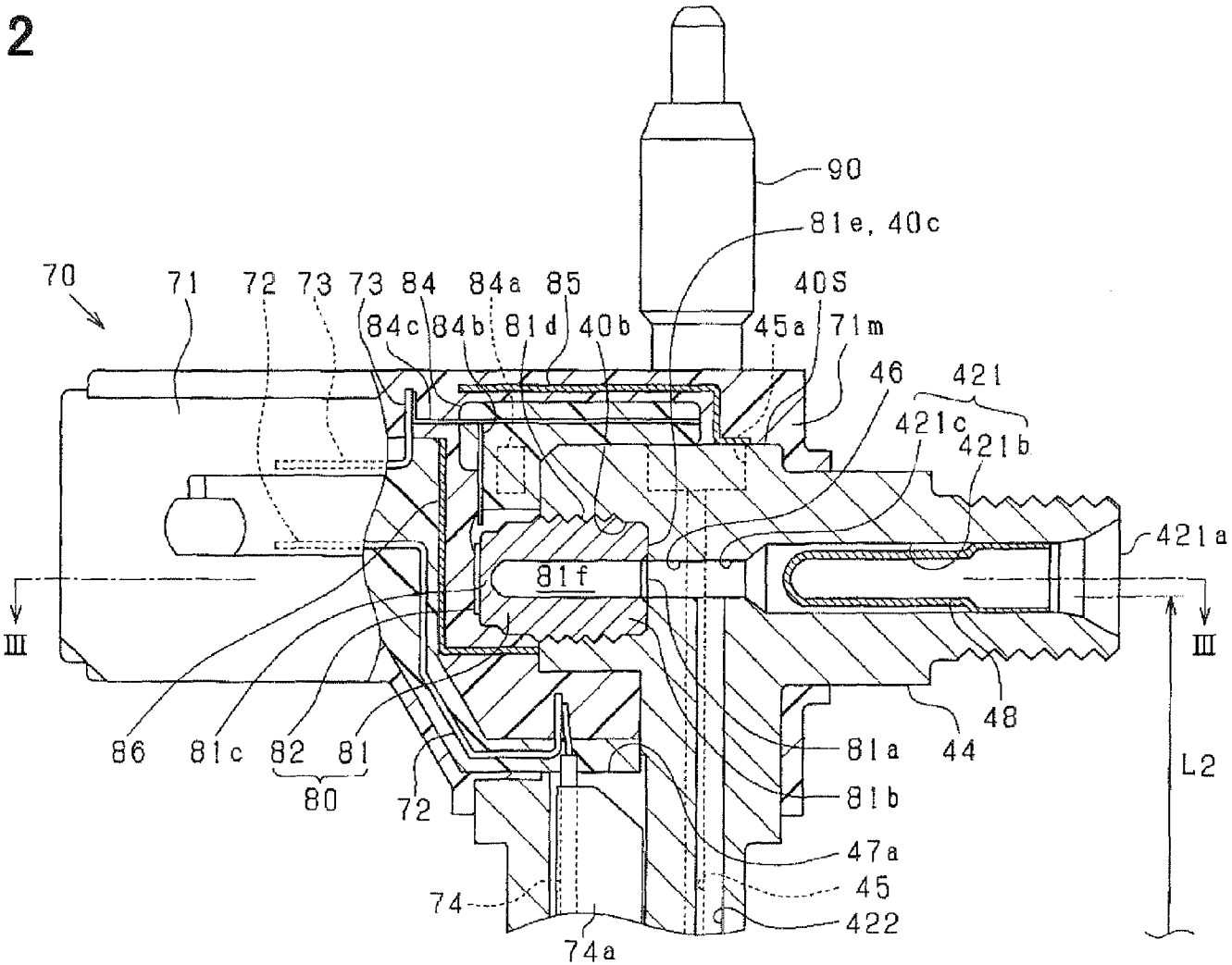
FIG. 2 is an enlarged view of FIG. 1.

The lead wire 74 is inserted and disposed in the lead wire insertion hole 47, which is formed in the main body 40, with the lead wire 74 held by a holding member 74*a* (see FIG. 2). The holding member 74*a* is made of a material (e.g., resin such as nylon) having lower hardness than metal, for preventing a coating of the lead wire 74 from wearing out. Furthermore, the holding member 74*a* has, for example, a predetermined shape and thickness such that the holding member 74*a* has higher rigidity than the lead wire 74.

Upon energization of the magnet coil 62, the armature 64 is attracted to the stator 63 to be displaced. A spring 66, which is accommodated in a central part of the stator 63, applies resilient force to the armature 64 in a direction in which the ball valve 65 closes the outflow passage 53 (i.e., downward in FIG. 1).

The pressure of high pressure fuel inside the nozzle body 20 and the main body 40 varies in accordance with fuel injection through the nozzle hole 22. A fuel pressure sensor 80 for detecting this pressure fluctuation is attached on the outer peripheral surface of the main body 40.

By detecting start time of decrease of the fuel pressure in accordance with a start of the injection through the nozzle hole 22 in a waveform of the pressure fluctuation which is detected by the fuel pressure sensor 80, actual injection start time is detected. Actual injection completion time is detected by detecting start time of increase of the fuel pressure in accordance with completion of the injection. By detecting a maximum value of a decrease in fuel pressure caused by the injection in addition to the injection start time and the injection completion time, injection quantity is detected.

Next, structure of the fuel pressure sensor 80 will be described below with reference to FIG. 2.

The fuel pressure sensor 80 includes a stem 81 (flexure element) that is resiliently deformed upon application of the pressure of high pressure fuel in the sensor passage 46 (described in greater detail hereinafter) to the fuel pressure sensor 80, and a strain gage 82 (sensor element) that converts the magnitude of flexure produced in the stem 81 into an electrical signal so as to output the signal as a pressure detection value.

The stem 81 includes a cylindrical portion 81*b* having a cylindrical shape, and a diaphragm portion 81*c* having a disc shape. An inflow port 81*a*, through which high pressure fuel is conducted into the stem 81, is formed at one end portion of the cylindrical portion 81*b*, and the diaphragm portion 81*c* covers the other end portion of the cylindrical portion 81*b*. The pressure of high pressure fuel, which flows into the cylindrical portion 81*b* through the inflow port 81*a*, is applied to an inner peripheral surface of the cylindrical portion 81*b* and the diaphragm portion 81*c*, and thereby the entire stem 81 is resiliently deformed.

The stem 81 is made of metal, and high strength and high hardness because of the application of very high pressure to the stem 81, and small deformation by thermal expansion of the stem 81, which results in little influence upon the strain gage 82 (i.e., small coefficient of thermal expansion), are required for the metallic material of the stem 81. More specifically, materials, which mainly contain iron (Fe), nickel (Ni), and cobalt (Co), or Fe and Ni, and to which titanium (Ti), niobium (Nb), and aluminum (Al), or Ti and Nb serving as precipitation strengthening materials are added, may be selected for the stem 81. The stem 81 may be formed from these materials by for example, press work, cutting work, or cold forging operation. Alternatively, materials, to which carbon (C), silicon (Si), manganese (Mn), phosphorus (P), or sulfur (S), for example, is added, may be selected.

An attaching hole 40*b*, in which the cylindrical portion 81*b* of the stem 81 is inserted, is formed on a side surface of the main body 40. By screwing an external thread portion 81*d*, which is formed on an outer peripheral surface of the cylindrical portion 81*b*, into an internal thread portion that is formed on an inner peripheral surface of the attaching hole 40*b*, the fuel pressure sensor 80 is attached to the main body 40.

A sensor side sealing surface 81*e* is formed on an end face of the cylindrical portion 81*b* located around the inflow port 81*a*, and a body side sealing surface 40*c* is formed on a bottom face of the attaching hole 40*b*. Both the sealing surfaces 81*e*, 40*c* are surfaces expanding perpendicular to an axial direction of the stem 81 (i.e., right and left directions in FIG. 2), and have shapes expanding annularly around the inflow port 81*a*.

By closely-attaching the sensor side sealing surface 81*e* on the body side sealing surface 40*c* with the surface 81*e* pressed on the surface 40*c*, a clearance between the main body 40 and the stem 81 is metal-touch sealed (metal-to-metal sealed). The force (axial force) pressing both the sealing surfaces 81*e*, 40*c* is generated by screwing the stem 81 to the main body 40. In other words, the attachment of the stem 81 to the main body 40 and the generation of axial force are simultaneously carried out.

The strain gage 82 is attached to the diaphragm portion 81*c*. Accordingly, the strain gage 82 detects the magnitude (resilient deformation amount) of flexure produced in the diaphragm portion 81*c* when the stem 81 is resiliently deformed to be enlarged by the pressure of high pressure fuel which flows into the cylindrical portion 81*b*.

A mold integrated circuit (IC) 84, which will be described below, is attached to an upper portion of the main body 40. The mold IC 84 is configured by resin-molding an electronic component 84*a* and electrodes 84*b*, 84*c*. By electrically connecting the electrode 84*b* to the strain gage 82 via a wire bond, the electronic component 84*a* is connected to the strain gage 82. The electrodes 84*c* are electrically connected respectively to the sensor connector terminals 73.

The electronic component 84*a* includes an amplifying circuit for amplifying a detection signal outputted from the strain gage 82, a filtering circuit for removing noise that overlaps with the detection signal, and a circuit for applying a voltage to the strain gage 82, for example.

The strain gage 82, to which the voltage is applied from the voltage applying circuit, includes a bridge circuit whose resistance value varies according to the magnitude of flexure produced in the diaphragm portion 81*c*. As a consequence, output voltage of the bridge circuit varies according to the flexure of the diaphragm portion 81*c*, and the output voltage is outputted to the amplifying circuit of the electronic component 84*a* as the detection value of pressure of high pressure fuel. The amplifying circuit amplifies the pressure detection value outputted from the strain gage 82 (bridge circuit), and the amplified signal is outputted from the sensor connector terminal 73 via the electrode 84*c*.

The sensor connector terminals 73 include a terminal for outputting the detection signal of the fuel pressure sensor 80, a terminal for supplying a power source, and a terminal for grounding. A connector of an external harness that is connected to an external device (not shown) such as an engine electronic control unit (ECU) is connected to the connector 70. Accordingly, the pressure detection signal outputted from the electronic component 84*a* is inputted into the engine ECU via the external harness.

The electronic component 84*a* and the strain gage 82 are covered in metal shield covers 85, 86. As a result, the shield covers 85, 86 block out extrinsic noise so as to protect the electronic component 84*a* and the strain gage 82.

The fuel pressure sensor 80, the mold IC 84, and the shield covers 85, 86 are molded in a resin material 71*m* together with the connector terminals 72, 73, and as a consequence, they are held by the main body 40. A part of the resin material 71*m* constitutes the connector housing 71.

Figure 3:
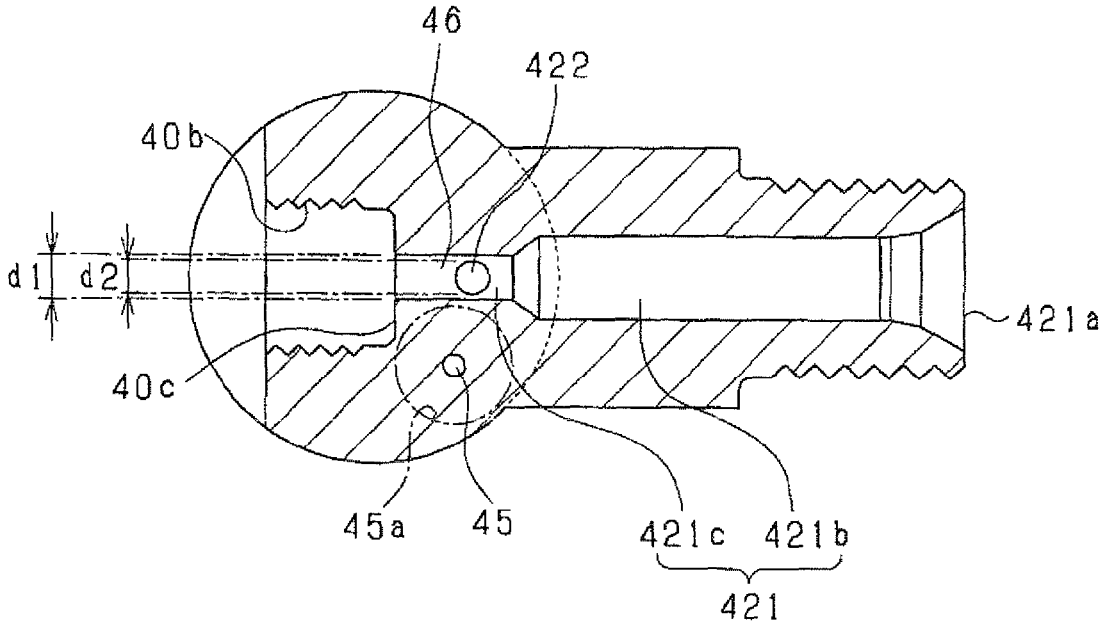
FIG. 3 is a cross-sectional view taken along a line III-III in FIG. 2.

Arrangement layout of the sensor passage 46, the high pressure passages 421, 422, the stem 81 (attaching hole 40*b*), and so forth, which are provided inside the main body 40, will be described in detail below with reference to FIGS. 2 and 3. FIG. 3 illustrates the main body 40 independently of the other components.

The high pressure passages 421, 422 respectively include the first passage 421 and the second passage 422, which are separately formed by drilling. The first passage 421 has a shape that extends from the supply port 421*a*, which opens on the outer peripheral surface (high pressure port 44) of the main body 40, in a radial direction of the cylinder of the main body 40. The second passage 422 has a shape that extends from a downstream end portion of the first passage 421 to a lower end surface 40R (see FIG. 1) of the main body 40 in the axial direction of the main body 40.

The first passage 421 includes a large diameter portion 421*b*, in which a filter 48 is inserted and disposed, and a small diameter portion 421*c*, which communicates with a downstream side of the large diameter portion 421*b* and has a smaller diameter than the large diameter portion 421*b*. The second passage 422 is connected to the small diameter portion 421*c*. As a result, the first passage 421 and the second passage 422 are perpendicularly connected.

The attaching hole 40*b*, in which the stem 81 is inserted and disposed, is arranged on the side surface of the cylinder of the main body 40 on its opposite side from the supply port 421*a*. The sensor passage 46 extends from the downstream end portion of the first passage 421 in an extended line of the first passage 421, and has a shape extending from a downstream end of the small diameter portion 421*c* in the radial direction of the main body 40.

The small diameter portion 421*c* and the sensor passage 46 are arranged coaxially, and have the same diameter. Accordingly, when drilling the small diameter portion 421*c*, the small diameter portion 421*c* and the sensor passage 46 are formed at one time, by extending a drilling length of the small diameter portion 421*c* from a length of the portion 421*c* so that the portion 421*c* passes through the main body 40.

In addition, in a state where the stem 81 is attached to the attaching hole 40*b*, an internal passage 81*f* (see FIG. 2) in the cylindrical portion 81*b* of the stem 81 is located coaxially with the sensor passage 46.

As illustrated in FIG. 3, a diameter d1 of a portion (i.e., small diameter portion 421*c*) of the first passage 421 to which the second passage 422 is connected is made larger than a diameter d2 of a portion (i.e., upper end portion) of the second passage 422 which is connected to the first passage 421.

The lead wire insertion hole 47 and the accommodating hole 43 are coaxially provided, and they are formed by drilling the main body 40 in its axial direction upward from the lower end surface 40R of the main body 40. An upper end opening 47*a* (see FIG. 2) of the lead wire insertion hole 47 is located downward of the sensor passage 46.

The low pressure passage 45 is formed by drilling the main body 40 from its lower end surface 40R in the axial direction of the main body 40 so that the passage 45 passes through the main body 40 in its axial direction. An attaching port 45*a* (discharge port) is formed on a portion of an upper end surface 40S (see FIG. 2) of the main body 40 that is located at an upper end of the low pressure passage 45.

Figure 4:
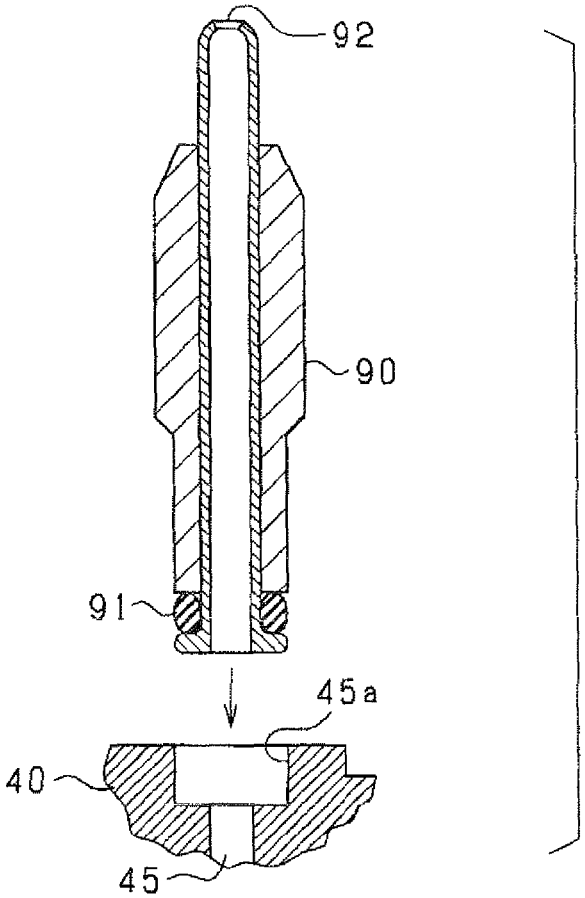
FIG. 4 is a diagram illustrating attachment of a low pressure connector in FIG. 2 to a main body.

As illustrated in FIG. 4, the low pressure connector 90 is inserted and disposed in the attaching port 45*a* of the main body 40 via an O ring 91 (seal material). The low pressure pipe (not shown) is connected to the low pressure connector 90 so that an opening 92, which is formed at an upper end of the low pressure connector 90, communicates with the low pressure pipe.

The high pressure port 44 extends radially from the outer peripheral surface of the main body 40. On the other hand, the low pressure connector 90 extends in the axial direction from the upper end surface 40S of the main body 40. The stem 81 extends radially from the outer peripheral surface of the main body 40 coaxially with the high pressure port 44.

Operation of the injector 10 will be described below.

When the energization of the magnet coil 62 is stopped, the ball valve 65 closes the outflow passage 53. Therefore, force that urges the needle 30 in the valve closing direction (i.e., sum of force due to the fuel pressure in the backpressure chamber 27 and urging force of the spring 26) is larger than force that presses the needle 30 upward in the valve opening direction (i.e., lift force generated due to the pressure fuel in the fuel accumulation chamber 24). As a result, the seat surface 331 of the needle 30 engages with the seating surface 221 to close communication between the high pressure passage 23 and the nozzle hole 22. Accordingly, fuel is not injected.

When the magnet coil 62 is energized, the armature 64 is attracted to the magnetized stator 63, so that the armature 64 is displaced toward the stator 63 against urging force of the spring 66. Consequently, upon application of the fuel pressure in the backpressure chamber 27 to the ball valve 65, the ball valve 65 opens the outflow passage 53. For this reason, the high pressure fuel in the backpressure chamber 27 is released to the low-pressure side through the outflow passage 53, and the fuel pressure in the backpressure chamber 27 is thereby reduced. In consequence, at the time that the force that presses the needle 30 upward in the valve opening direction becomes larger than force that urges the needle 30 in the valve closing direction, the needle 30 is lifted up. Because of that, the high pressure fuel, which is supplied from the common rail to the injector 10, is injected from the nozzle hole 22 through the high pressure passages 421, 422 of the main body 40, the high pressure passage 51 of the orifice plate 50, and the high pressure passage 23 in the nozzle body 20.

As a result, according to the present embodiment, the following advantageous effects are produced.

The sensor passage 46 is formed coaxially with the first passage 421 (high pressure passage), which is formed inside the main body 40. Accordingly, the sensor passage 46 is formed (e.g., drilled) at one time together with the first passage 421, so that increase of working man-hours is avoided.

The sensor passage 46 is formed coaxially with the first passage 421. Accordingly, increase of the number of stress concentration regions (see the numerals y1, y2 in FIG. 6) is avoided and pressure resistance inside the main body 40 against the high pressure fuel is therefore improved.

Figure 6:
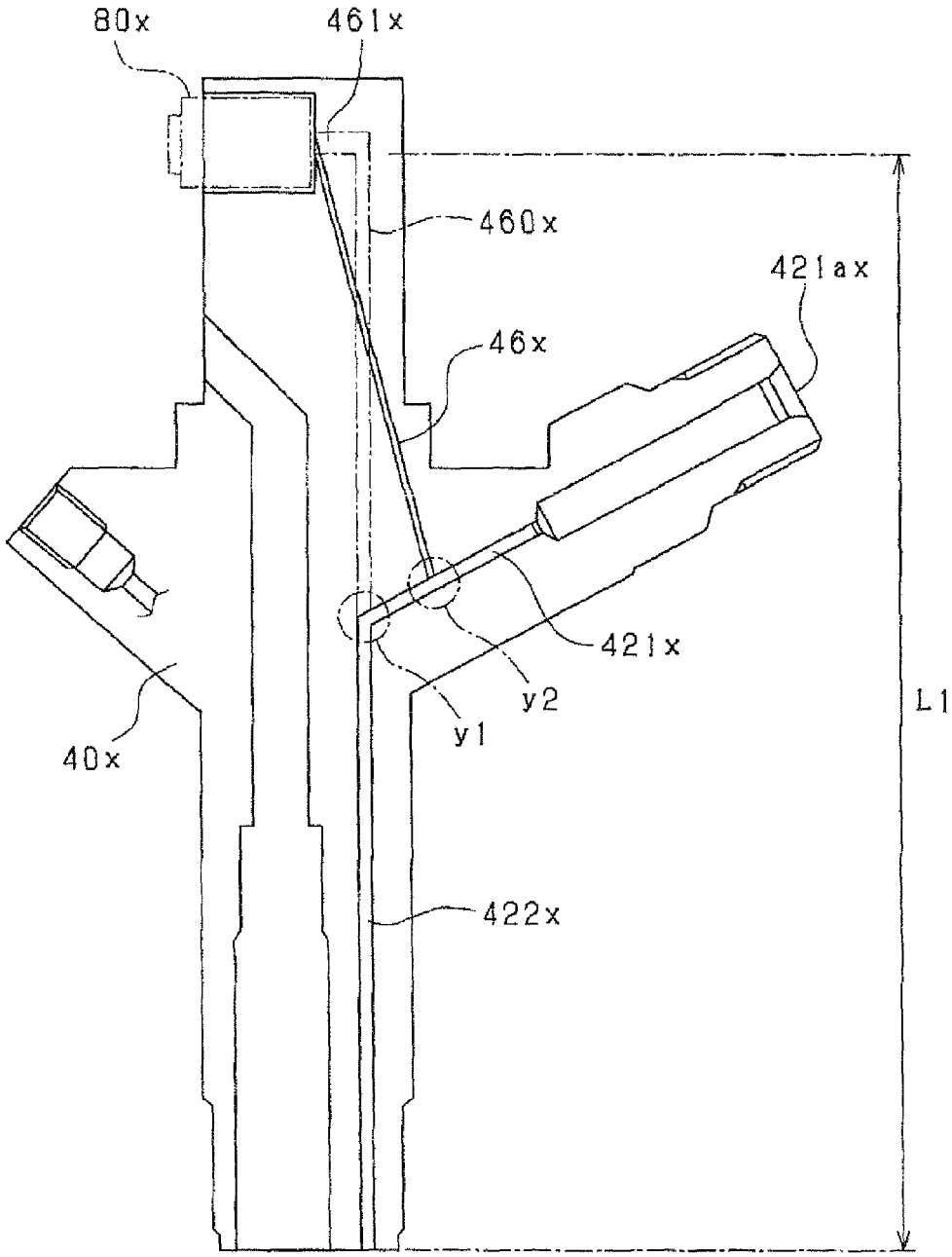
FIG. 6 RELATED ART
FIG. 6 is a sectional view illustrating structure of a main body of an injector studied independently of the invention.

Since the sensor passage 46 is formed coaxially with the first passage 421, a forming length (L2 in FIG. 1) of the second passage 422 is made short compared to the forming length L1 in FIG. 6. Accordingly, the upper end portion of the second passage 422 is easily placed accurately at a certain position of the first passage 421, so that a requirement of high forming accuracy for the second passage 422 is avoided.

The second passage 422 extending in the insertion direction, in which the injector 10 is inserted into the cylinder head E2, has a longer passage length than the first passage 421 and the sensor passage 46. Therefore, there is concern for a shift of the end portion of the second passage 422 from the first passage 421 and the sensor passage 46.

To ease the above-described concern, the diameter d1 of the small diameter portion 421*c* of the first passage 421, to which the second passage 422 is connected, is made larger than the diameter d2 of the second passage 422. Accordingly, a shift of the upper end portion of the second passage 422 in the radial direction of the main body 40 is permissible. Thus, accuracy in drilling required for the second passage 422 is reduced.

The attaching port 45*a* (discharge port), to which the low pressure connector 90 is attached, is formed on the upper end surface 40S of the main body 40. Accordingly, the low pressure passage 45 is formed to extend in a straight line in the axial direction of the main body 40. Therefore, when drilling the low pressure passage 45, working man-hours for the passage 45 are reduced in comparison to the formation of the attaching port 45*a* on the side surface of the cylinder of the main body 40.

Contrary to the present embodiment, if the discharge port is formed on the side surface of the main body 40, a rotational position of the attaching port 45*a* greatly varies according to a rotational position of the main body 40 around its axial direction. Accordingly, working efficiency of operation for attaching the low pressure pipe to the low pressure connector 90, which is attached to the attaching port 45*a*, deteriorates. On the other hand, in the present embodiment in which the attaching port 45*a* is formed on the upper end surface 40S of the main body 40, the great variation of the rotational position of the attaching port 45*a* is avoided, so that the working efficiency for attachment of the low pressure pipe is improved.

Contrary to the present embodiment, if the discharge port 45*a* is formed on the side surface of the cylinder of the main body 40, when drilling a discharge passage (low pressure passage), which leads surplus fuel (low pressure fuel) into the discharge port 45*a*, in the main body 40, a first low pressure passage needs to be formed to extend in the axial direction from an end face of the cylinder of the main body 40, and then a second low pressure passage, which communicates between an end portion of the first low pressure passage and the discharge port 45*a*, needs to be formed to extend in the radial direction. For this reason, the low pressure passage needs to be formed by separately drilling the first and second low pressure passages. On the other hand, in the present embodiment, the discharge port 45*a* is formed on an end face of the cylinder of the main body 40 on its opposite side from the nozzle hole 22. Accordingly, the radially extending second low pressure passage is eliminated, and thus the low pressure passage is easily formed.

Contrary to the present embodiment, if the high pressure port 44 is formed on the upper end surface 40S of the main body 40, a size of the injector 10 becomes large in the axial direction. Moreover, even if an elbow that bends the flow direction of fuel at a 90-degree angle is employed for the high pressure pipe, which is connected to the high pressure port 44, a curvature radius of the elbow cannot be made sufficiently small because fuel flowing in the elbow has high pressure. For this reason, an arrangement space for the injector 10 and the high pressure pipe in an engine cover of the engine becomes large in the axial direction due to the height of the elbow.

In the present embodiment, on the other hand, high pressure fuel is supplied from the outer peripheral surface-side of the main body 40 by forming the high pressure port 44 on the outer peripheral surface of the main body 40. Accordingly, the increase of the arrangement space required for the injector 10 and the high pressure pipe in the axial direction is avoided.

In the present embodiment, the stem 81 is formed separately from the main body 40. Accordingly, the following effects are produced.

When internal stress of the main body 40, which is generated by thermal expansion and contraction of the main body 40, propagates to the stem 81, propagation loss of the stress is made large. Thus, by providing the stem 81 separately from the main body 40, influence of the flexure of the main body 40 upon the stem 81 becomes small. In the present embodiment, in which the strain gage 82 is attached to the stem 81 that is provided separately from the main body 40, the influence of the flexure produced in the main body 40 upon the strain gage 82 is limited, as compared with direct attachment of the strain gage 82 to the main body 40. Consequently, accuracy in detecting the fuel pressure by the fuel pressure sensor 80 is improved.

In addition to the formation of the stem 81 separately from the main body 40, a material having a smaller coefficient of thermal expansion than the main body 40 is chosen for the material of the stem 81. Accordingly, generation of flexure in the stem 81 as a result of the thermal expansion and contraction of the stem 81 itself is limited. Furthermore, compared to formation of the entire main body 40 from a material having a small coefficient of thermal expansion, only the stem 81 needs to be formed from a material having a small coefficient of thermal expansion. As a consequence, the material cost is reduced.

Lastly, since the stem 81 is provided separately from the main body 40, whether the output value of the strain gage 82 is normal is inspected prior to the attachment of the stem 81 with the strain gage 82 being attached thereto, to the main body 40. Hence, working efficiency of this inspection is improved.

Second Embodiment

Figure 5:
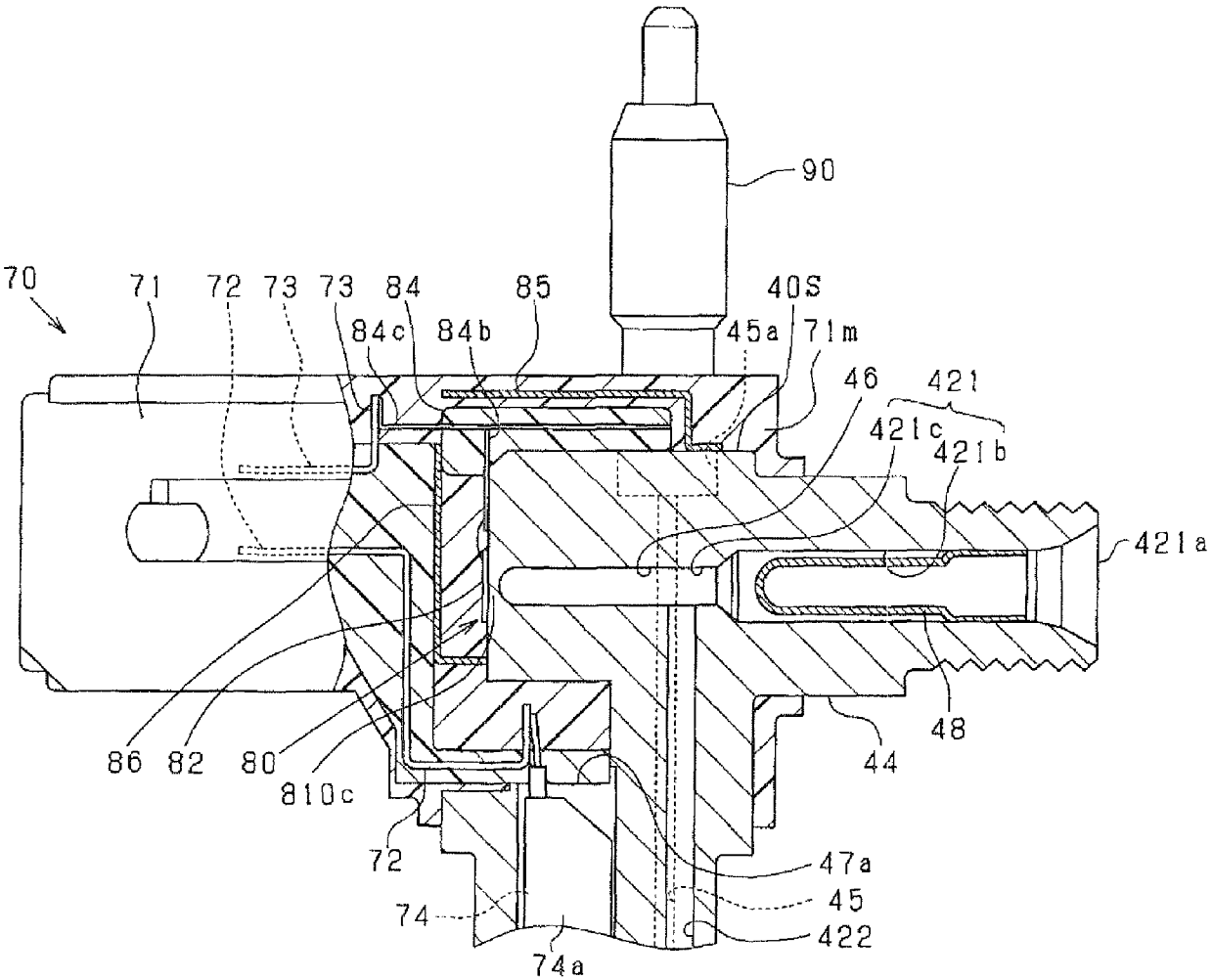
FIG. 5 is an enlarged view illustrating an injector in accordance with a second embodiment of the invention.

Unlike the formation of the stem 81 separately from the main body 40 in the above first embodiment, in the present embodiment illustrated in FIG. 5, the stem 81 is eliminated and a strain gage 82 is attached directly on a main body 40.

More specifically, in the present embodiment, when drilling a sensor passage 46 together with a first passage 421, a main body 40 is drilled from a supply port 421*a* without passing through the main body 40 so as to leave a thin wall part 810*c*, which corresponds to the diaphragm portion 81*c* of the stem 81. Then, the strain gage 82 (sensor element) is attached on an outer surface of the thin wall part 810*c*. Accordingly, the strain gage 82 detects pressure of high pressure fuel by detecting the amount of flexure of the thin wall part 810*c* produced by the pressure of high pressure fuel in the sensor passage 46.

In the present embodiment as well, advantageous effects similar to the first to seventh effects in the first embodiment are produced. Because the stem 81 is eliminated, the formation of the sealing surfaces 81*e*, 40*c*, which is needed in the first embodiment, is rendered unnecessary.

Modifications of the above embodiments will be described below. The invention is not limited to the descriptions in the above-described embodiments, and may be embodied through the modifications as follows. Furthermore, characteristic structures in the embodiments may be arbitrarily combined.

In the first embodiment, the electromagnetic unit 60 including the stator 63 and the armature 64 is employed as an electric actuator for opening and closing the needle 30. Alternatively, a piezoelectric actuator, which is constituted of a layered body (piezoelectric stack) obtained by stacking many piezoelectric elements, may be employed.

In the embodiments, the first passage 421 and the sensor passage 46, which are coaxially provided, are formed to extend perpendicular to the axial direction of the main body 40. Alternatively, they may be formed to be inclined with respect to this axial direction.

In the embodiments, the second passage 422 is formed to extend parallel to the axial direction of the main body 40. Alternatively, the passage 422 may be formed to be inclined with respect to this axial direction.

In the embodiments, the invention is applied to the injector of the diesel engine. Alternatively, the invention may be applied to a gasoline engine, particularly, to a direct gasoline-injection engine, which injects fuel directly into the combustion chamber E1.

Additional advantages and modifications will readily occur to those skilled in the art. The invention in its broader terms is therefore not limited to the specific details, representative apparatus, and illustrative examples shown and described.

What is claimed is:

1. An injector for an internal combustion engine, comprising:

a nozzle body that is adapted to be inserted and disposed in a cylinder head of the engine and that includes an injection hole through which high pressure fuel is injected;

a main body that has a cylindrical shape extending in a direction of insertion of the nozzle body in the cylinder head and that includes:

a supply port formed on an outer peripheral surface of the main body, wherein high pressure fuel is supplied into the main body through the supply port; and a high pressure passage through which high pressure fuel flows from the supply port toward the injection hole and which has:

a first passage extending from the supply port in a radial direction of the main body; and a second passage extending from a fuel downstream end portion of the first passage toward the injection hole in the direction of insertion of the nozzle body; and a fuel pressure sensor that is attached on the outer peripheral surface of the main body and configured to detect pressure of high pressure fuel, wherein:

the sensor is located diametrically on an opposite side of an axis of the cylindrical shape of the main body from the supply port; and the main body further includes a sensor passage, which branches from the high pressure passage in such a manner as to extend from the fuel downstream end portion of the first passage in an imaginary extension of the first passage so that high pressure fuel flows into the sensor through the sensor passage.

2. The injector according to claim 1, wherein a portion of the first passage that is connected to the second passage has a diameter, which is larger than a diameter of the second passage.

3. The injector according to claim 1, wherein an end surface of the main body on an opposite side of the main body from the injection hole in an axial direction of the main body includes a discharge port, through which a surplus of high pressure fuel is discharged.

4. An injector for an internal combustion engine, comprising:

a nozzle body that is adapted to be inserted and disposed in a cylinder head of the engine and that includes an injection hole through which high pressure fuel is injected;

a main body that has a cylindrical shape extending in a direction of insertion of the nozzle body in the cylinder head and that includes:

a supply port formed on an outer peripheral surface of the main body, wherein high pressure fuel is supplied into the main body through the supply port; and a high pressure passage through which high pressure fuel flows from the supply port toward the injection hole and which has:

a first passage extending from the supply port in a radial direction of the main body; and a second passage extending from a fuel downstream end portion of the first passage toward the injection hole in the direction of insertion of the nozzle body; and a fuel pressure sensor that is attached on the outer peripheral surface of the main body and configured to detect pressure of high pressure fuel, wherein:

the supply port and the sensor are diametrically opposed to each other;

the main body further includes a sensor passage, which branches from the high pressure passage in such a manner as to extend from the fuel downstream end portion of the first passage in an imaginary extension of the first passage so that high pressure fuel flows into the sensor through the sensor passage; and an end surface of the main body on an opposite side of the main body from the injection hole in an axial direction of the main body includes a discharge port, through which a surplus of high pressure fuel is discharged.

* * * * *